US008631605B1

(12) United States Patent
Davenport

(10) Patent No.: US 8,631,605 B1
(45) Date of Patent: Jan. 21, 2014

(54) MULTI-PANE INSULATED GLASS UNIT ASSEMBLY INCORPORATING A PET DOOR

(71) Applicant: Michael Davenport, Dunwoody, GA (US)

(72) Inventor: Michael Davenport, Dunwoody, GA (US)

( * ) Notice: Subject to any disclaimer, the term of this patent is extended or adjusted under 35 U.S.C. 154(b) by 0 days.

(21) Appl. No.: 13/732,333

(22) Filed: Dec. 31, 2012

(51) Int. Cl.
*E06B 7/28* (2006.01)

(52) U.S. Cl.
USPC ..... 49/169; 49/501

(58) Field of Classification Search
USPC ..... 49/163, 168, 169, 170, 171, 501
See application file for complete search history.

(56) References Cited

U.S. PATENT DOCUMENTS 3,654,733 A * 4/1972 Blackwell ..... 49/168
3,918,203 A * 11/1975 Ellison, Jr. ..... 49/168
3,932,971 A * 1/1976 Day ..... 52/171.3
4,001,970 A * 1/1977 Miyamoto ..... 49/171
4,047,331 A * 9/1977 Davlantes ..... 49/171
4,408,416 A * 10/1983 Davlantes ..... 49/168
4,899,508 A * 2/1990 Biebuyck ..... 52/235
4,914,864 A * 4/1990 Hohenfeld ..... 49/506
5,035,116 A * 7/1991 Main ..... 62/77
5,150,983 A * 9/1992 Bogenhagen ..... 403/402
5,199,234 A * 4/1993 Guhl ..... 52/200
5,467,557 A * 11/1995 Jones ..... 49/171
5,946,855 A * 9/1999 Miconi ..... 49/163
6,061,961 A * 5/2000 Rupe ..... 49/164
6,261,694 B1 * 7/2001 Iacovangelo ..... 428/412
6,272,793 B1 * 8/2001 Davlantes ..... 49/168
6,385,909 B1 * 5/2002 Marsh et al. ..... 49/169
7,180,489 B2 * 2/2007 Libby et al. ..... 345/87
7,207,141 B2 * 4/2007 Sullivan ..... 49/169
7,494,176 B1 * 2/2009 Duffy ..... 296/152
RE41,502 E * 8/2010 Neaux ..... 52/204.51
8,302,348 B2 * 11/2012 Noyes ..... 49/169
2006/0053693 A1 * 3/2006 Sullivan ..... 49/168

* cited by examiner

*Primary Examiner* — Jerry Redman

(57) ABSTRACT

A glass assembly for a dwelling having a first pane and a second pane integrated together with at least one spacer for encapsulating an inert gas forming an insulated glass unit. The first and second panes define an outer periphery and an internal periphery. The internal periphery defines a pet channel and the two panes have openings for receiving a pet door. A pet is enabled to pass from one side of the glass assembly, through the glass assembly, and exiting on the other side of the glass assembly while the inert gas is maintained within the insulated glass unit.

7 Claims, 4 Drawing Sheets

MULTI-PANE INSULATED GLASS UNIT ASSEMBLY INCORPORATING A PET DOOR

FIELD OF THE INVENTION

The present invention relates generally to insulating glass units. More specifically, the invention relates to methods of producing insulating glass units which have been manufactured to retain its insulating properties while enabling interfacing with a pet door assembly either as an integrated unit or adaptive to receiving a pet door assembly.

BACKGROUND OF THE INVENTION

An insulating glass unit (i.e., an "IG unit" or "IGU") typically includes a pair of generally parallel panes held in a spaced-apart relationship by a spacer. The basic structure of a conventional double-glazed IG unit includes peripheral inner surfaces of the panes joined by a space to define a between-pane space. While many standard IG units simply contain air, high performance IG units are sometimes filled with insulating gas to increase the insulating capacity of the units. Filling the between-pane space of an IG unit with insulating gas advantageously increases the "R" value (i.e., the resistance to heat flow through the unit) of the resulting unit. Ideally, the between-pane space is filled with a gas that is heavier and less thermally conductive than air. Argon is commonly used as an insulating gas fill. Krypton is an even better insulator than argon. However, it is also significantly more expensive. Other inert gases can be used as well. The glass panes are hermetically sealed to retain the gas within the interior space defined by the separate panes of glass and respective spacers. These IG units have a rectangular profile and are generally positioned within door frames and sliding glass doors.

Pet doors are utilized to provide access for pets such as cats and dogs to exit and enter homes without the need for an owner to repeatedly open and close doors. Pet doors are commonly known and used. Pet doors are customarily designed for integration with doors of a house. Holes are cut out of the door frame and the pet door is installed in the frame of the door.

However, in certain circumstances, where the glass is utilized throughout the majority of the door, such as in a sliding glass door on a patio, the pet door is larger than the frame and hence the frame cannot be cut for installation. You cannot cut the tempered glass in the door or it will shatter.

U.S. Pat. No. 7,784,430 illustrates a common solution for installation of a pet door in a sliding patio environment. An independent pane or door section which includes a pet door is positioned adjacent to the regular sliding door pane in sliding frame. While suitable for its intended purpose, this construction does not provide for the insulation benefits of a well sealed sliding door system.

Alternatively, U.S. Pat. No. 4,760,872 discloses a pet door for installation in a fixed or moveable glass door or window. This patent discloses that the single pane of glass has been cut for installation of the pet door. The pane is encased in a frame and with the corner cut out; the pet door is adapted for being received within the remaining portion of the frame. While suitable for its intended purpose, such a construction of a pet door is not suitable for an insulated glass unit as the moment the glass is cut, the inert gases will escape.

Accordingly, there is a need in the art for a pet door which is integrated with an insulated glass unit to provide the thermal benefits of the insulated glass unit while permitting utilization by a pet.

SUMMARY OF THE INVENTION

A glass assembly for a dwelling comprises a first pane extending in a first direction and including an outer edge defining an outer periphery and an internal edge defining an internal periphery. A second pane offset from the first pane and extending parallel to the first direction and including an outer edge defining an outer periphery and an internal edge defining an internal periphery. At least one spacer interconnecting the outer edge of the first pane with the outer edge of the second pane and interconnecting the internal edge of the first pane with the internal edge of the second pane defining an enclosed interior. The spacer integrating the internal edges of the first and second pane to define a pet channel of sufficient size to enable a pet to pass from a profile defined by the first pane to a profile defined by the second pane. An inert gas disposed within the enclosed interior. A pet door assembly is also included. The pet door assembly includes a first pet door frame surrounding the internal edge of the first pane; and a second pet door frame surrounding the internal edge of the second pane. The first pet door frame and second pet door define a pet door opening communicating with the pet channel for receiving a pet and enabling a pet to pass from one side of the glass assembly, through the glass assembly, and exiting on the other side of the glass assembly.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
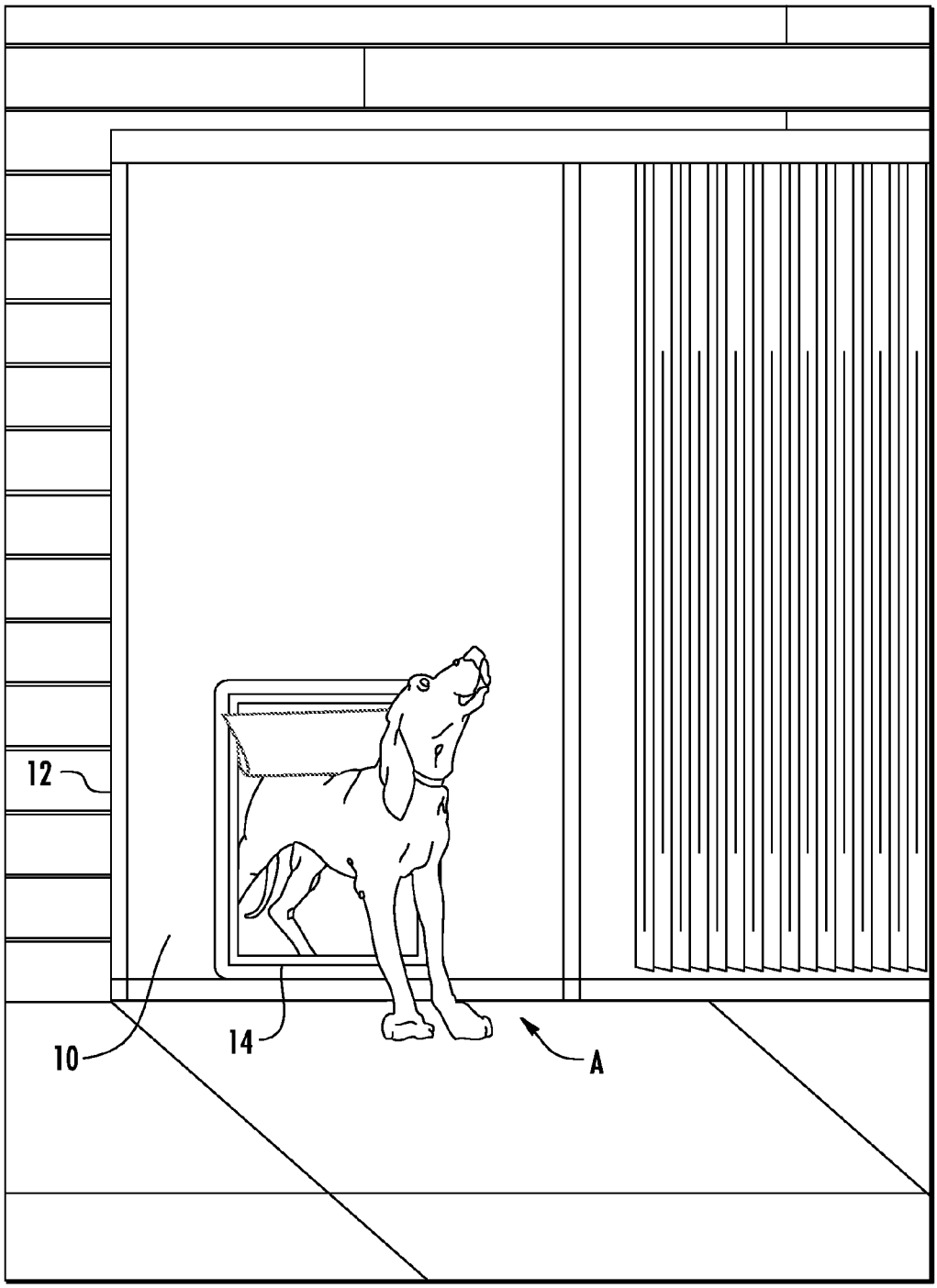
FIG. 1 is a general view illustrating the insulated glass unit with an integrated pet door according to the present invention.

The following detailed description is to be read with reference to the drawings, in which like elements in different drawings have been given like reference numerals. The drawings, which are not necessarily to scale, depict selected embodiments and are not intended to limit the scope of the invention. Skilled artisans will recognize that the examples provided in the present disclosure have many suitable alternatives that can be utilized, and which fall within the scope of the invention.

FIG. 1 illustrates one example of an insulated glass unit 10 that can be provided in the present invention. The insulated glass unit 10 includes two separated panes of tempered glass encompassed within a hermetically sealed frame 12 with an inert gas such as argon or krypton contained within the interior space defined by the panes and frames. In the embodiment shown in FIG. 1, the insulated glass unit 10 is of the sliding door variety. However, the insulated glass unit 10 could also be a door. In both circumstances, the insulated glass unit 10 encompasses a pet door 14 which extends through the glass boundary of the insulated glass unit. The combination of the insulated glass unit 10 and the pet door 14 forms a multi-pane insulated glass unit assembly incorporating a pet door A.

Figure 2:
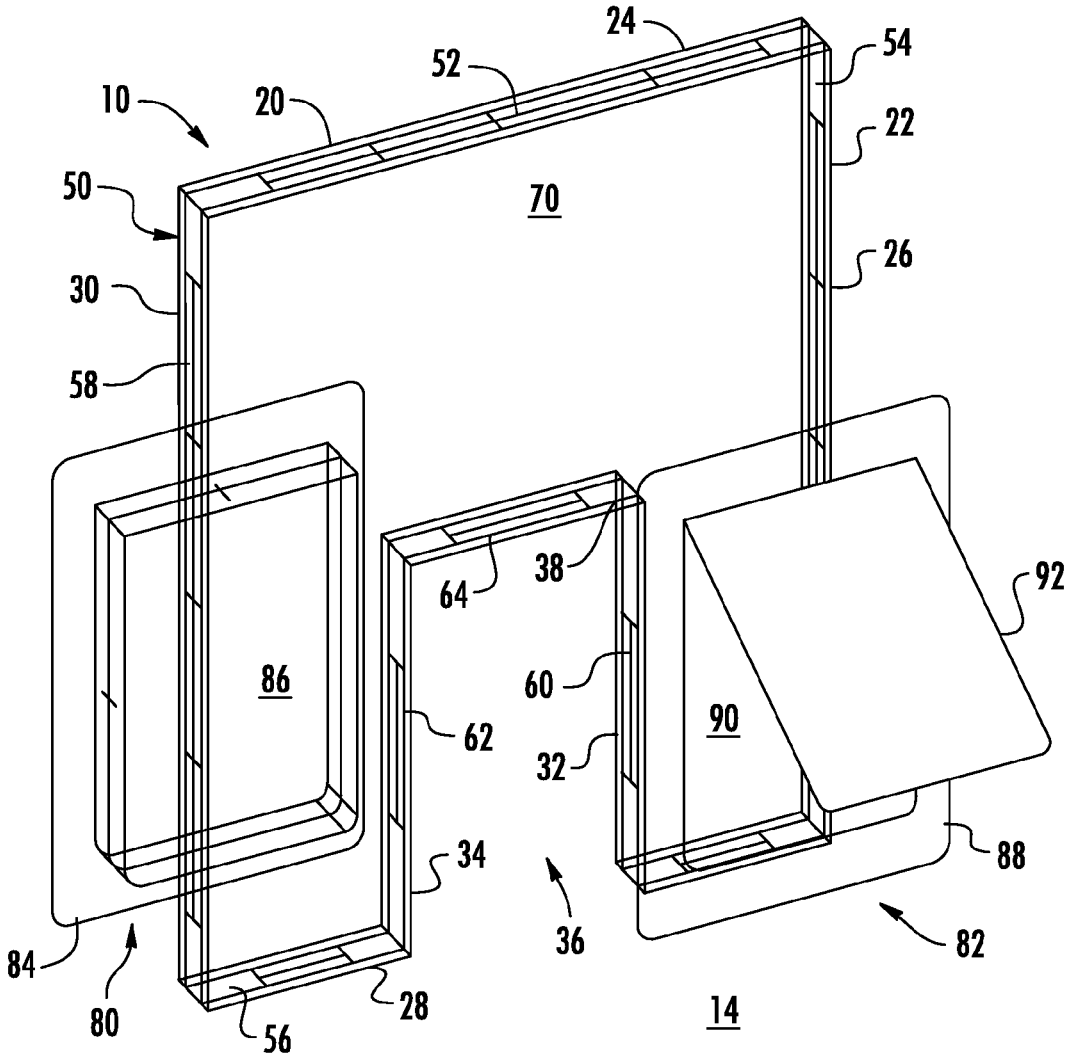
FIG. 2 is an exploded view illustrating the hermetically sealed insulated glass unit in combination with the interior and exterior components of a pet door.

FIG. 2 illustrates the components of the multi-pane insulated glass unit assembly incorporating a pet door A according to one embodiment of the present invention. As illustrated, the insulated glass unit 10 includes a first pane 20 and a second pane 22. Each pane is preferably a mirror image of the other providing for a symmetrical design enabling the incorporation of a pet door into the profile of the respective panes. As shown in FIG. 2, each pane includes outer edges; top upper edge 24, right outer edge 26, bottom outer edge 28 and left outer edge 30. In the vicinity of bottom outer edge 28, the respective panes include an interior right edge 32 and an interior left edge 34 offset from each other defining a pet passage through the profile of the two panes. In the preferred embodiment, a top interior edge 38 is also provided. As shown in FIG. 1, insulated glass unit 10 and the various edges are designed for incorporation into an external frame 12.

As shown in FIG. 2, first pane 20 and second pane 22 are integrated with respect to each other via a plurality of spacers 50. In particular, spacers 50 integrated each respective edge of first pane 20 and second pane 22 in a manner that provides for a hermetic seal. In particular spacers 50 include a top upper edge spacer, 52, a right outer edge spacer, 54, a bottom outer edge spacer 56 and left outer edge spacer 58 which when integrated with the respective edges of the first and second panes define an external periphery. Of particular importance are interior right edge spacer 60, interior left edge spacer 62 and upper interior edge spacer 64 which when combined with the respective interior edges of the first and second panes define an internal periphery. The spacers 50 can be of any suitable material. Typically, spacers are filled with or contain desiccant to remove moisture trapped in the gas space during manufacturing, thereby lowering the dew point of the gas in that space, and preventing condensation from forming on surface. In the preferred embodiment, the interior edge spacers are preferably translucent such as glass. Spacer 20 in combination with first pane 20 and second pane 22 define an interior 70 for receiving an inert gas denser than air such as argon or krypton.

This construction defines insulated glass unit 10 and enables the inert gas to be retained within the unit while defining pet passage 36 which extends within the profile of the of the insulated glass unit of sufficient size for receiving a pet door. While FIG. 2 illustrates one possible design of the pet passage 36 and respective interior edges, a lower edge is also possible for defining a fully encircled pet passage.

As shown in FIG. 2, pet door 14 includes an external pet door member 80 and an internal pet door member 82. External pet door member 80 includes a frame 84 which defines a pet opening 86 of sufficient size to enable a pet to walk through. Likewise, internal pet door member 82 includes a frame 88 which defines a pet opening 90 of similar size for communicating with the external door pet opening 86. A closing flap 92 is provided for closing off the pet passage. In particular, the external pet door member frame 84 and internal pet door member frame 88 are sized such that they are wider than the pet passage 36 and may be integrated with insulated glass unit 10 such that the respective frames of the pet door extend around the entire perimeter of the pet passage 36. As showing in FIG. 2, one embodiment of a pet door is constructed such that the external pet door member 80 includes a flange which extends into pet passage 36 and preferably engages the respective interior edges of the insulated glass unit. While mention has been made to the interior and exterior pet door frame components, they are interchangeable and could be positioned either internally or externally. Furthermore, while an interior mating flange is desired, the pet door assembly could consist of frame members only without any internally extending flanges.

Figure 3:
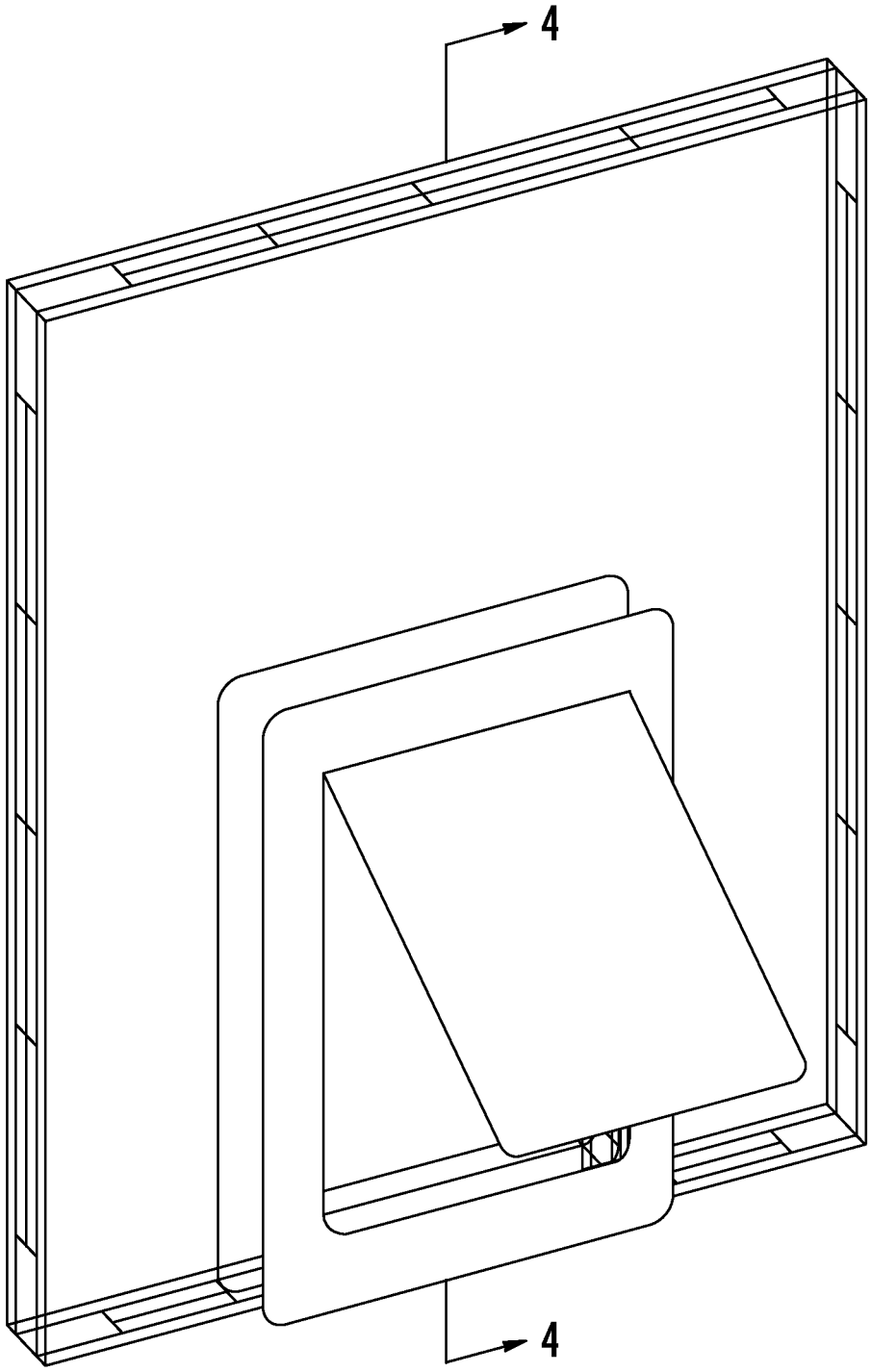
FIG. 3 is a perspective view illustrating the hermetically sealed insulated glass unit integrated with the interior and exterior components of a pet door.

FIG. 3 illustrates a fully integrated multi-pane insulated glass unit assembly incorporating a pet door. In the preferred embodiment the pet door frame members are carried by the integrated glass unit and affixed utilizing an adhesive or other similar attachment mechanism. As shown in FIG. 3, the pet door is "through" the glass enabling the aesthetic properties of the glass door or pane to be enjoyed while maintaining the insulating properties desired and having the convenient benefits of a pet door. A sealant is preferable around the edges of the pet door frame members for providing sufficient weathering protection in the interior of the dwelling.

Figure 4:
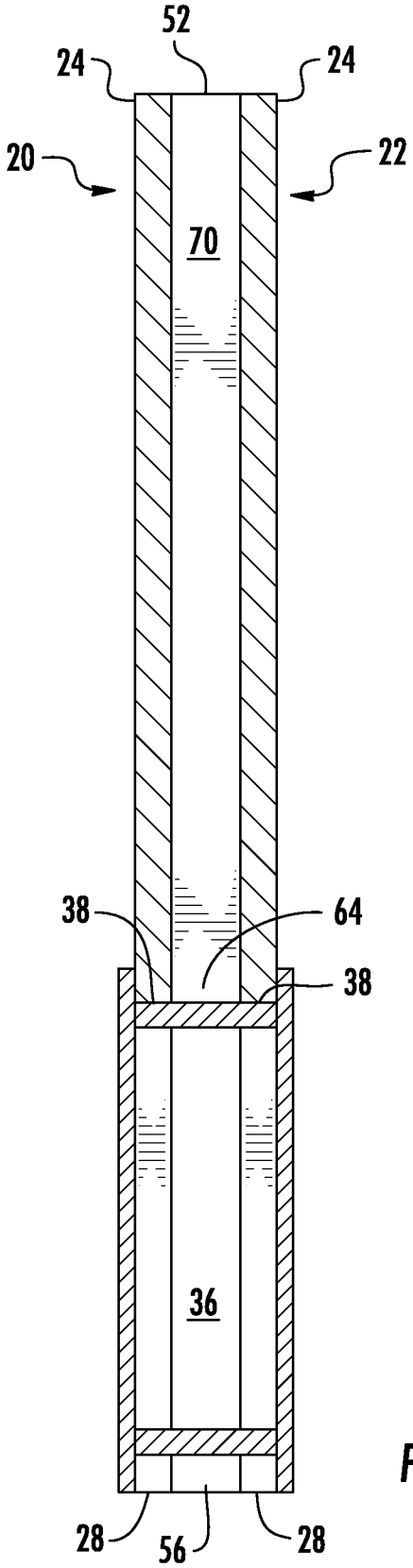
FIG. 4 is a cross-sectional view of FIG. 3 illustrating a cross section of the hermetically sealed insulated glass unit integrated with the interior and exterior components of a pet door.

FIG. 4 illustrates a cross-section of the assembly as shown in FIG. 3. The top upper edges 24 of first pane 20 and second pane 22 are interconnected with top upper edge spacer 52 and respective bottom outer edge 28 are interconnect with bottom outer edge spacer 56. Internally, upper interior edge spacer 64 interconnects the respective interior upper edges 38. In this configuration a pet opening 90 is defined and an insulated glass pane interior 70 maintains inert gas. External pet door member 80 and internal pet door member 82 are shown in an embodiment which includes an internally extending flange 88 which extends into the pet passage 36 for providing a path for an animal to pass. A low emittance coating may be applied to either the first or second pane Thus it may be seen that according to the invention an advantageous design for an insulated glass assembly may be had which provides for the opportunity for a pet to pass through the insulated glass assembly while maintaining the insulating properties of the assembly.

What is claimed is:

1. A glass assembly for a dwelling comprising:

a first pane extending in a first direction and including an outer edge defining an outer periphery and internal edges defining an internal periphery;

a second pane offset from said first pane and extending parallel to said first direction and including an outer edge defining an outer periphery and internal edges defining an internal periphery;

at least one spacer interconnecting said outer edge of said first pane with said outer edge of said second pane and interconnecting said internal edge of said first pane with said internal edge of said second pane defining an enclosed interior;

said at least one spacer and said internal edges of said first and second pane defining a pet channel of sufficient size to enable a pet to pass from a profile defined by said first pane to a profile defined by said second pane;

an inert gas disposed within said enclosed interior;

a pet door assembly including:

a first pet door frame surrounding the internal edges of said first pane; and a second pet door frame surrounding the internal edges of said second pane wherein said first pet door frame and second pet door define a pet door opening communicating with said pet channel for receiving a pet and enabling a pet to pass from one side of the glass assembly, through the glass assembly, and exiting on the other side of said glass assembly.

2. The glass assembly of claim 1 wherein said inert gas is either argon or krypton.

3. The glass assembly of claim 1 wherein said internal edges of said first and second pane include a left edge, a right edge, a top edge and a bottom edge defining a rectangular opening within said first and second panes.

4. The glass assembly of claim 1 wherein said spacer is glass.

5. The glass assembly of claim 1 wherein said spacer includes an external spacer and an internal spacer, said internal spacer being translucent.

6. The glass assembly of claim 1 wherein at least a portion of at least one of the first pane or the second pane is coated with a low-E material.

7. A glass assembly for receiving a pet door comprising:

a first pane extending in a first direction and including an outer edge defining an outer periphery having at a right and left vertical edge and an upper and lower horizontal edge, and an internal edge having at least a right and left vertical edge offset from said right and left vertical edge of said outer periphery defining an internal periphery;

a second pane offset from said first pane and extending parallel to said first direction and including an outer edge defining an outer periphery having at a right and left vertical edge and an upper and lower horizontal edge, and an internal edge having at least a right and left vertical edge offset from said right and left vertical edge of said outer periphery defining an internal periphery;

at least one spacer interconnecting said outer edge of said first pane with said outer edge of said second pane and interconnecting said internal edge of said first pane with said internal edge of said second pane defining an enclosed interior;

said at least one spacer and said internal edges of said first and second pane defining a pet channel of sufficient size to enable a pet to pass from a profile defined by said first pane to a profile defined by said second pane;

an inert gas disposed within said enclosed interior; and wherein said pet channel includes an opening defined by said first pane and an opening defined by said second pane enabling a pet to pass from one side of the glass assembly, through the glass assembly, and exiting on the other side of said glass assembly while maintaining said inert gas within said enclosed interior.

* * * * *